US005738088A

United States Patent [19]

Townsend

[11] Patent Number: 5,738,088

[45] Date of Patent: Apr. 14, 1998

[54] BREATHING APPARATUS

[75] Inventor: Paul Townsend, Newcastle-upon-Tyne, United Kingdom

[73] Assignee: Draeger Limited, Blyth, United Kingdom

[21] Appl. No.: 688,664

[22] Filed: Jul. 29, 1996

[30] Foreign Application Priority Data

Aug. 23, 1995 [GB] United Kingdom ..... 9517242

[51] Int. Cl.[6] ..... A62B 9/04

[52] U.S. Cl. ..... 128/202.27; 128/205.24

[58] Field of Search ..... 128/202.27, 205.24

[56] References Cited

U.S. PATENT DOCUMENTS

| | | | |
|---|---|---|---|
| 3,238,943 | 3/1966 | Holley | 128/205.24 |
| 3,486,730 | 12/1969 | Potash | 128/202.27 |
| 3,744,526 | 7/1973 | MacNiel | 128/205.24 |
| 4,328,798 | 5/1982 | Isaacson | 128/202.27 |
| 4,392,490 | 7/1983 | Mattingly et al. | 128/202.27 |
| 4,449,524 | 5/1984 | Gray | 128/202.27 |
| 4,714,077 | 12/1987 | Lambert | 128/202.27 |
| 4,838,256 | 6/1989 | Miltz | 128/202.27 |
| 4,974,584 | 12/1990 | Goodnoe | 128/202.27 |
| 5,213,095 | 5/1993 | Dague | 128/202.27 |

FOREIGN PATENT DOCUMENTS

| | | |
|---|---|---|
| 235688 | 9/1987 | European Pat. Off. . |
| 1594982 | 8/1981 | United Kingdom . |
| 2127298 | 4/1984 | United Kingdom . |
| 2155985 | 10/1985 | United Kingdom . |
| 9415804 | 7/1994 | WIPO . |

*Primary Examiner*—Aaron J. Lewis
*Attorney, Agent, or Firm*—Emrich & Dithmar

[57] ABSTRACT

A two-stage breathing apparatus comprises a compressed air supply cylinder (1) provided with a cylinder valve (2) communicating through a high-pressure duct (3) with a manifold (4). A first high-pressure branch (5) of the manifold (4) communicates with a pressure indicator warning unit (6) and a second high pressure branch (7), comprising a high pressure flexible hose, connects the manifold (4) via a non-return valve (8) with a high pressure quick release connector (10). The manifold (4) contains a pressure reducer (11) which feeds a demand valve (12) provided on a breathing mask (14) via a further flexible hose (13).

The non-return valve (8) permits flow in the direction from the high-pressure quick release connector (10) to the supply cylinder (1), but prevents flow in the direction from the supply tank (1) to the high-pressure quick release connector (10). Consequently, the supply tank (1) can be replenished rapidly via the quick release connector (10), but if the connector (10) fails or the high pressure flexible hose bursts, the non-return valve prevents the loss of compressed air to the atmosphere.

8 Claims, 2 Drawing Sheets

BREATHING APPARATUS

This invention relates to breathing apparatus, and particularly although not exclusively, relates to self-contained breathing apparatus (SCBA) for use in hazardous environments.

A wearer of a conventional SCBA can carry on working until a low pressure warning device on the SCBA indicates that the air supply is low. The wearer must then go to a safe control area where he or she uncouples the used cylinder and replaces it with a fresh fully charged cylinder. The disadvantage of this system is that useful work time is wasted in travelling to and from the safe area to replenish the air supply.

According to the present invention there is provided a breathing apparatus comprising a manifold having:

- a first inlet connected to a portable breathing gas supply tank;
- an outlet for the passage of breathable gas from the supply tank for inhalation by a user of the apparatus;
- a second inlet provided with a connector for connecting the manifold to a source of pressurised breathing gas; and
- a non-return valve which permits flow in the direction from the connector to the supply tank.

The non-return valve may comprise a valve chamber connected to the second inlet by a passage and a valve element located in the valve chamber and having an elongate portion extending into the passage.

The elongate portion of the valve element may comprise a metal rod. Preferably the rod is made of stainless steel. The valve element may comprise a dome shaped sealing member fixed to an end of the elongate portion. Preferably the sealing member is made of nylon.

A breathing apparatus according to the present invention enables a user's air supply to be replenished even in an environment which is immediately dangerous to life and health because disconnection of the breathing gas supply tank is unnecessary.

For a better understanding of the present invention and to show more clearly how it may be carried into effect, reference will now be made, by way of example, to the accompanying drawings, in which.

Figure 1:
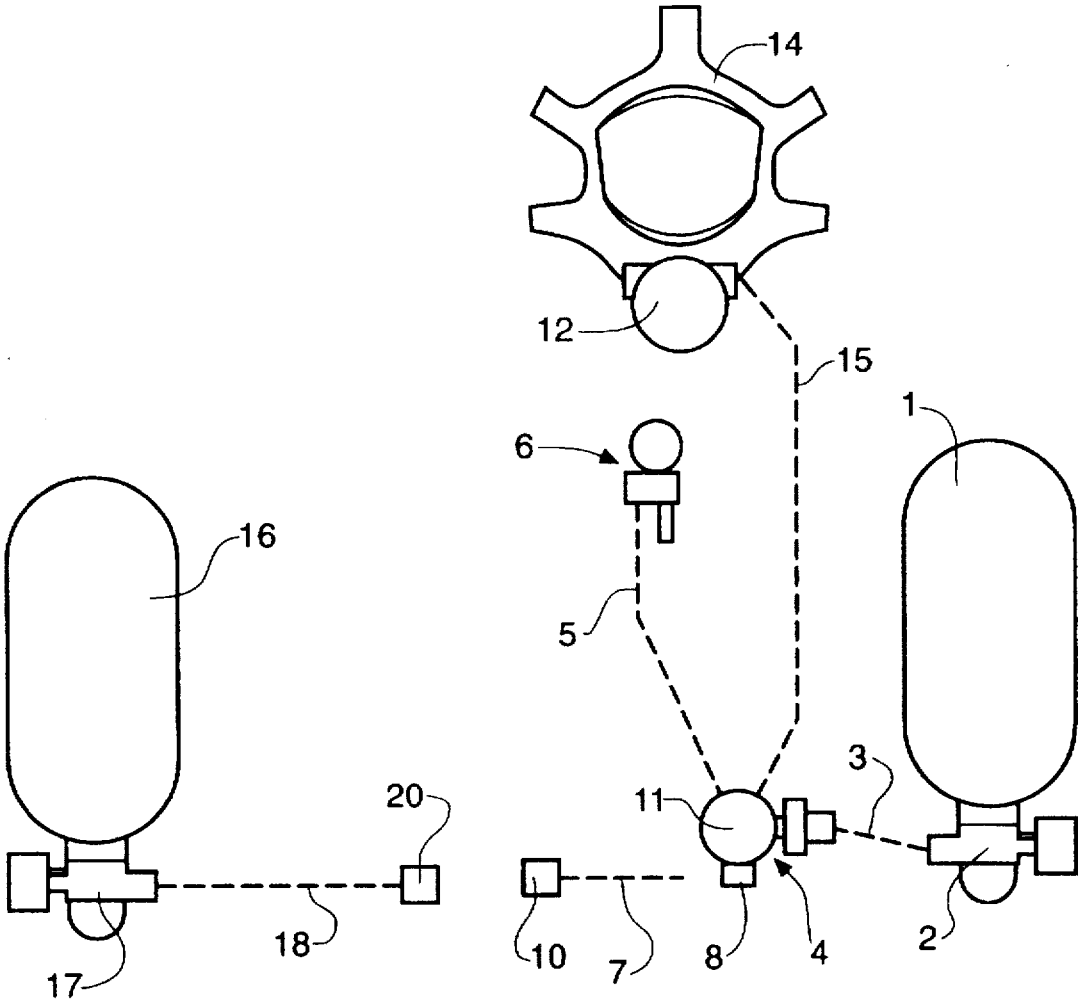
FIG. 1 shows diagrammatically a self-contained, compressed air breathing apparatus and an external independent supply apparatus.

Referring to FIG. 1, the two-stage breathing apparatus, which is self-contained and portable, comprises a compressed air supply cylinder 1 provided with a cylinder valve 2 communicating through a high-pressure duct 3 with a first inlet of a manifold 4. A first high-pressure branch 5 of the manifold 4 communicates with a pressure indicator warning unit 6 and a second high pressure branch 7, comprising a high pressure flexible hose, communicates via a non-return valve 8 with a high-pressure quick release connector 10. The manifold 4 includes a pressure reducer 11 having an outlet which feeds a demand valve 12 provided on a breathing mask 14 via a further flexible hose 15.

The compressed air supply comprises a compressed air cylinder 16 communicating via a cylinder valve 17 with a high-pressure flexible hose 18. The hose 18 has attached to its downstream end a quick release connector 20 which is complementary with the connector 10 forming part of the breathing apparatus.

Figure 2:
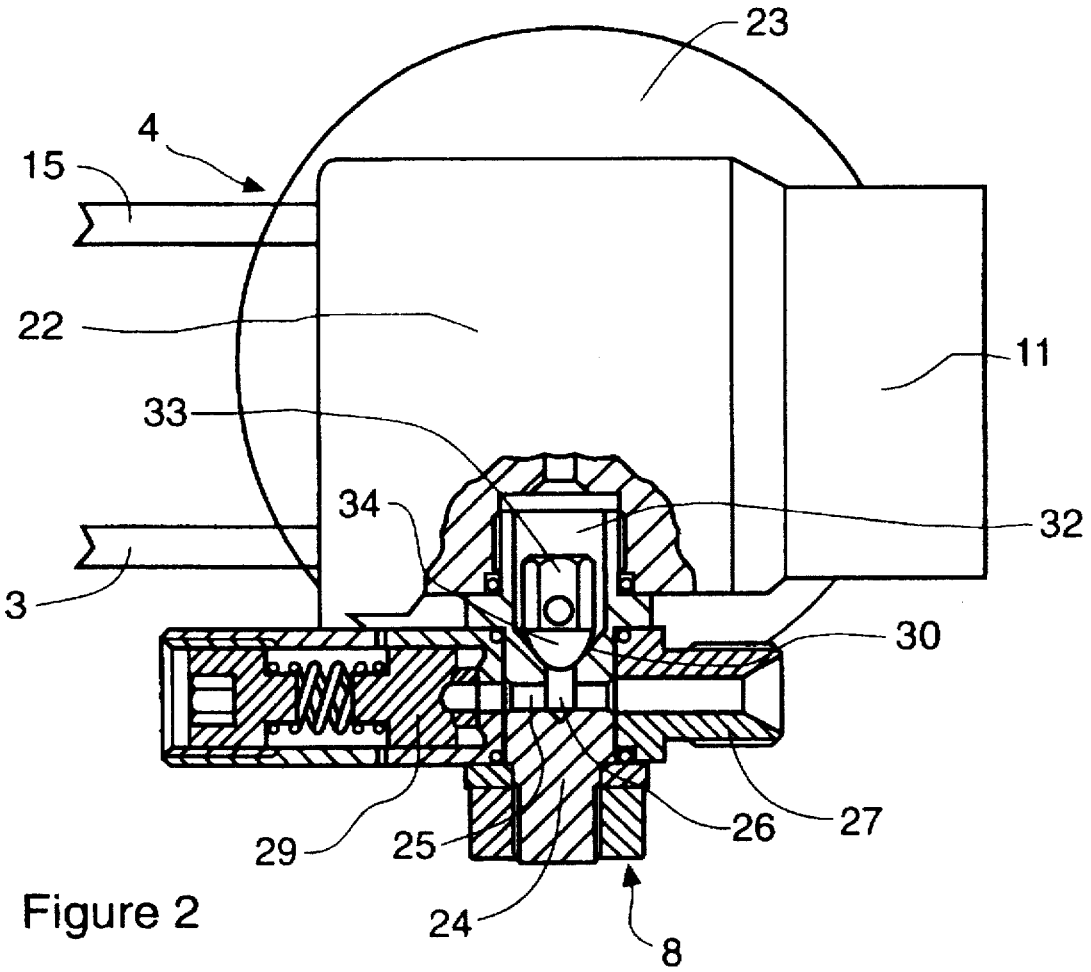
FIG. 2 is an enlarged cut-away view of the valve arrangement of the breathing apparatus of FIG. 1.

The manifold 4 is shown in more detail in FIG. 2. The manifold 4 comprises a main body portion 22 to which is connected the pressure reducer 11 and the non-return valve 8. A cylinder connector hand wheel 23 is provided to tighten the manifold 4 to the cylinder valve 2.

The non-return valve 8 comprises a cylindrical stainless steel housing 24 in which is formed a transverse air passage 25 connected to an axial air passage 26. The transverse passage 25 has an inlet at one end connected to the high pressure flexible hose 7 by means of a connector 27 and at the other end is connected to a relief valve 29.

The axial air passage 26 is flared outwardly at one end to form a valve seat 30 situated at the bottom of a cylindrical chamber 32. A valve element 33 is loosely received within the cylindrical chamber 32 and has a conical valve portion 34 which is of complementary shape to the valve seat 30. The cylindrical chamber 32 is connected directly to the high pressure branch 5 of the manifold 4 and is connected to the low pressure hose 15 of the manifold 4 via the pressure reducer 11.

Figure 3:
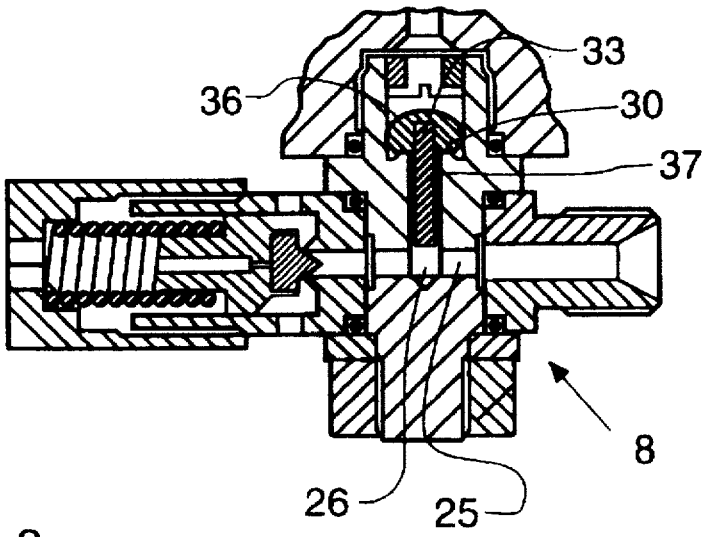
FIG. 3 is an enlarged cut-away view of an alternative embodiment of non-return valve provided in the valve arrangement of FIG. 2.

FIG. 3 shows an alternative embodiment of non-return valve 8 in which the valve element 33 comprises a nylon dome-shaped sealing member 36 mounted on a stainless steel rod 37 which is loosely received in the axial air passage 26. The rod 37 maintains the alignment of the valve element 33 in the cylindrical chamber 32 throughout its range of movement and ensures correct alignment of the sealing member 36 relative to the valve seat 30 as the valve closes.

In use of the self-contained breathing apparatus, the compressed air passes from the cylinder 1 by way of the cylinder valve 2 and the pressure reducer 11 in the manifold 4 to the demand valve 12. The pressure reducer 11 reduces the supply cylinder pressure to an intermediate pressure and the demand valve 12 reduces the intermediate pressure to a low pressure suitable for respiration.

In order to recharge cylinder 1 with supply cylinder 16, the connectors 10 and 20 are connected together. This connection can be made regardless of the pressure remaining in the cylinder 1, owing to the incorporation of the non-return valve 8 in the manifold 4. As the connection is made, the valves in the quick release connectors 10, 20 open allowing compressed air to pass into the non-return valve 8. The air flow lifts the valve member 33 from the valve seat 30 and passes through the manifold 4 into the cylinder 1 and via the pressure reducer 11, to the demand valve 12 on the breathing mask 14. In this way the cylinder 1 is re-charged, whilst the breathing mask 14 continues to be supplied with air.

Alternatively, the independent supply apparatus 16 can be connected to the breathing apparatus with the valve 2 closed. Then, when the quick release couplings 10, 20 are joined, air is supplied from the cylinder 16 to the breathing mask 14 without re-charging the cylinder 1.

If the pressure in supply cylinder 16 exceeds a value set at the relief valve 29, the relief valve 29 opens to allow air to vent to the atmosphere until the pressure drops to below the preset value. This arrangement prevents damage to and possible explosion of the breathing apparatus supply cylinder 1 if it is connected to a refill cylinder 16 which is fully charged and of a higher pressure rating. Although the relief valve is a useful safety feature, it may be omitted where connection to an air supply of a higher pressure rating is not possible.

If an empty or depleted supply cylinder 16 is connected to the cylinder 1 of the breathing apparatus, such that the air pressure in the cylinder 1 is greater than the air pressure in the supply cylinder 16, the non-return valve 8 will remain shut, preventing the loss of air from the breathing apparatus cylinder 1. Furthermore, if the high pressure quick connect couplings 10, 20 blow apart or if the high pressure hoses 7 and 18 are breached, the non-return valve will shut preventing loss of air from the cylinder 1 of the breathing apparatus. In this way, the unintentional loss of breathing air is prevented even if the refilling procedure is carried out incorrectly or if the re-filling apparatus is damaged.

It is thereby made possible for a two-stage, self-contained, breathing apparatus to be re-charged in a hazardous environment on the wearer, without disrupting the breathing function to the wearer and without jeopardising the wearer's remaining air supply.

Although the invention is described in relation to a two-stage breathing apparatus, it is equally applicable to a single stage breathing apparatus in which the pressure reducer is omitted or to an apparatus having more than two pressure stages.

The compressed air supply could comprise a cylinder bank instead of a single cylinder 16, in which case a change-over valve could be provided, whereby one cylinder can be replaced independently of another, thus giving an inexhaustible supply for as long as replacement cylinders are available.

Alternatively, the compressed air supply could comprise a large tank or reservoir of compressed air or an air compressor. The compressed air supply may be situated at the work site or may be situated remotely and connected to the work site by a compressed air line.

I claim:

1. Breathing apparatus comprising a manifold having:

a first inlet connected to a portable breathing gas supply tank;

an outlet for the passage of breathing gas from the supply tank for inhalation by a user of the apparatus;

a second inlet provided with a connector for connecting the manifold to a source of pressurized breathing gas; and a non-return valve responsive only to gas pressure which permits flow in the direction from the connector to the supply tank and which prevents flow in the direction from the supply tank to the connector.

2. Breathing apparatus as claimed in claim 1, in which the non-return valve comprises a valve chamber connected to the second inlet by a passage and a valve element located in the valve chamber, an elongate portion of the valve element extending into the passage.

3. Breathing apparatus as claimed in claim 2, in which the elongate portion of the valve element comprises a metal rod.

4. Breathing apparatus as claimed in claim 3, in which the metal rod is made of stainless steel.

5. Breathing apparatus as claimed in claim 2, in which a dome shaped sealing member is fixed to an end of the elongate portion of the valve element.

6. Breathing apparatus as claimed in claim 5, in which the sealing member is made of nylon.

7. Breathing apparatus as claimed in claim 1, in which the connector comprises a quick release coupling.

8. Breathing apparatus as claimed in claim 7, in which the quick release coupling is connected to the second inlet by a flexible hose.

* * * * *